United States Patent [19]

Tokumasu et al.

[11] Patent Number: 4,989,841

[45] Date of Patent: Feb. 5, 1991

[54] METAL CONTINUOUSLY MELTING AND RETAINING FURNACE

[75] Inventors: Kenzo Tokumasu, Kawagoe; Katsuo Taki, Kawasaki; Ryotatsu Ootsuka, Sakai; Masaaki Nakamura, Tokyo; Tatsuo Akino, Saitama, all of Japan

[73] Assignees: Honda Foundry Co., Ltd., Kawagoe; Taisei Furnace Ind. Co., Ltd., Ayase; Showa Aluminum Corporation, Sakai, all of Japan

[21] Appl. No.: 338,837

[22] Filed: Apr. 14, 1989

[30] Foreign Application Priority Data

Apr. 21, 1988 [JP] Japan ..... 63-98522

[51] Int. Cl.[5] ..... F27B 3/04

[52] U.S. Cl. ..... 266/217; 266/225; 266/226; 266/900; 266/901

[58] Field of Search ..... 266/225, 215, 217, 226, 266/235, 900, 901; 75/68 R, 65

[56] References Cited

U.S. PATENT DOCUMENTS

| | | | |
|---|---|---|---|
| 4,426,068 | 1/1984 | Gimond et al. | 266/217 |
| 4,443,004 | 4/1984 | Hicter et al. | 266/226 |
| 4,784,374 | 11/1988 | Pelton | 266/215 |

*Primary Examiner*—Melvyn J. Andrews
*Attorney, Agent, or Firm*—Armstrong, Nikaido, Marmelstein, Kubovcik and Murray

[57] ABSTRACT

A metal continuously melting and retaining furnace including a retaining chamber which retains therein a molten metal fed from a melting chamber, a ladling chamber from which the molten metal is ladled out, and a treating chamber between the retaining and ladling chambers and having means of producing bubbles of a molten metal-refining gas and means of stirring the molten metal. A molten metal inlet port between the retaining chamber and the treating chamber and a molten metal outlet port between the treating chamber and the ladling chamber are disposed so as not to face directly to each other. In addition, a bubble baffle plate stands on the bottom surface of the treating chamber near the molten metal outlet port so as to oppose thereto. This makes it possible to provide a molten metal with a good yield, which is refined to a higher degree and is most suitable for producing a high quality thin cast product by casting. This also inhibits molten metal refining gas bubbles with inclusions entrained therein from flowing into the molten metal outlet port to reliably prevent reduction in the degree of refining the molten metal in the ladling chamber.

19 Claims, 3 Drawing Sheets

METAL CONTINUOUSLY MELTING AND RETAINING FURNACE

BACKGROUND OF THE INVENTION

1. Field of the Invention

The present invention relates to a metal continuously melting and retaining furnace.

2. Description of the Prior Art

There is such a conventionally known retaining furnace in which a lance for ejecting an inert gas is disposed in a ladling chamber from which a molten metal is ladled, so that the molten metal is subjected to a refining treatment such as degassing and removal of oxides.

However, there is a problem that the above refining means can refine the molten metal only to a low degree and for this reason, a thin walled cast product of high quality cannot be obtained thereby.

SUMMARY OF THE INVENTION

With the foregoing in view, it is an object of the present invention to provide a metal continuously melting and retaining furnace of the type described above in which a molten metal can be obtained with a high refined degree.

To accomplish the above object, according to the present invention, there is proposed a metal continuously melting and retaining furnace comprising a retaining chamber which retains a molten metal fed from a melting chamber, a ladling chamber from which the molten metal is ladled, and a treating chamber provided between the retaining and ladling chambers and installed with means of producing bubbles of a molten metal-refining gas and means of stirring the molten metal, wherein a molten metal inlet port between the retaining chamber and the treating chamber and a molten metal outlet port between the treating chamber and the ladling chamber are disposed in an offset relation to each other.

In addition, the present invention proposes an arrangement that the metal continuously melting and retaining furnace has a bubble baffle plate which stands on a bottom surface of the treating chamber in proximity to and in an opposed relation to the molten metal outlet port.

With the above construction, the molten metal stays or is held in the treating chamber due to an offset structure of the molten metal inlet and outlet ports and during such stay, the molten metal is subjected to stirring to be brought into sufficient contact with the molten metal refining gas bubbles, whereby refining of the molten metal can be performed efficiently and reliably. Moreover, because the refining treatment is carried out through mechanical stirring, the loss of metal can be substantially reduced as compared with a case utilizing the flux in the refining operation.

In addition, the provision of the bubble baffle plate results in an advantage that when the molten metal refining gas bubbles are floating up with inclusions entrained therein during refining treatment, the bubbles are prevented from flowing into the molten metal outlet port by the bubble baffle plate to avoid lowering of the degree of refining the molten metal in the ladling chamber. Thus the molten metal can be continuously ladled out from the ladling chamber.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 3 illustrate one embodiment of the present invention, wherein FIG. 1 is a longitudinal sectional front view of a metal continuously melting and retaining furnace according to this embodiment, taken along a line I—I in FIG. 2;

FIG. 2 is a cross-sectional plan view taken along a line II—II in FIG. 1; and FIG. 3 is a plan view of an essential portion;

DESCRIPTION OF THE PREFERRED EMBODIMENTS

Figure 1:
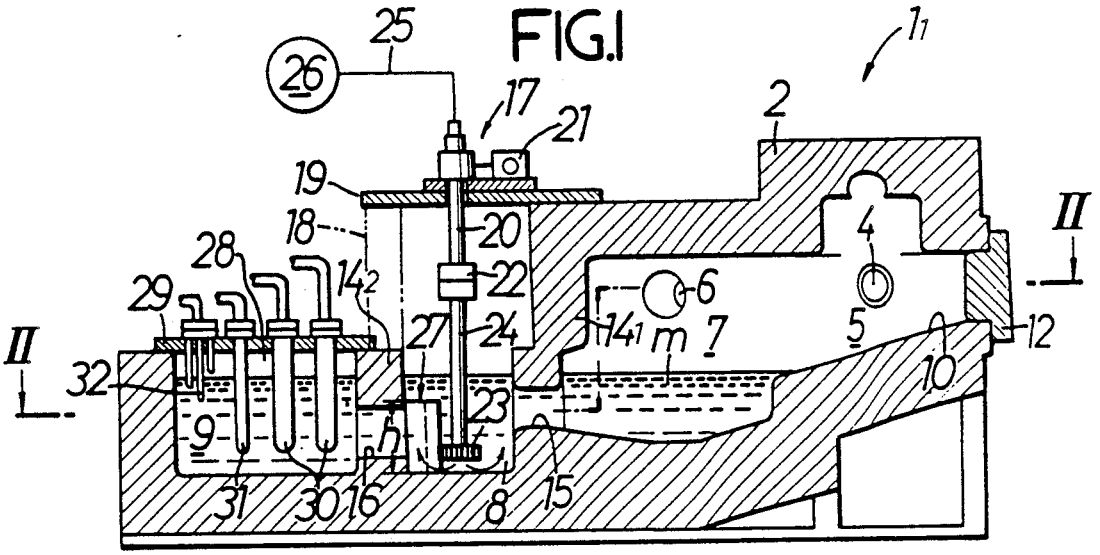
Figure 2:
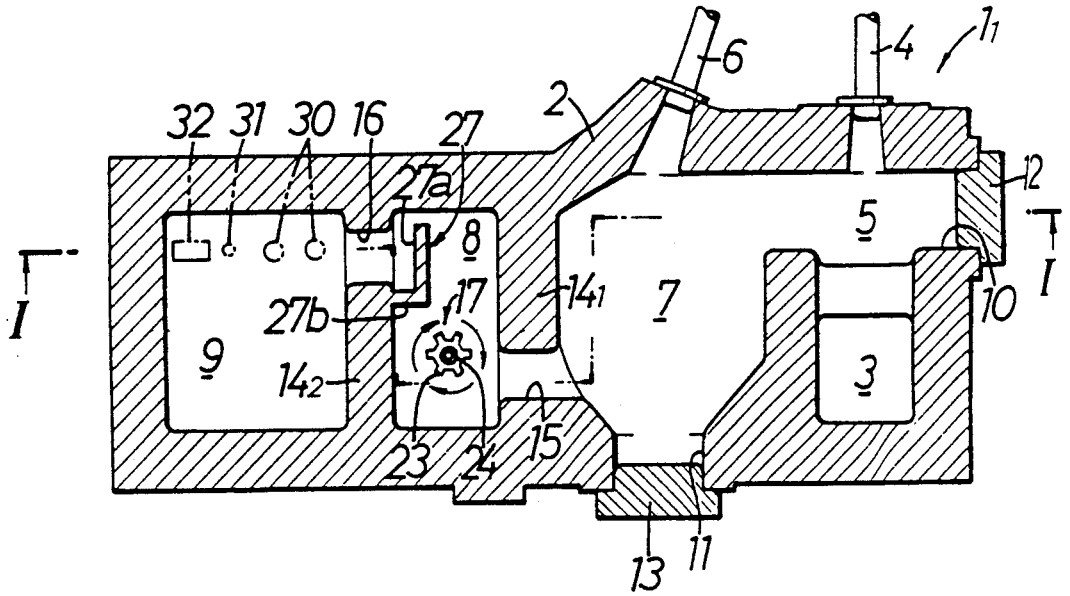
Figure 3:
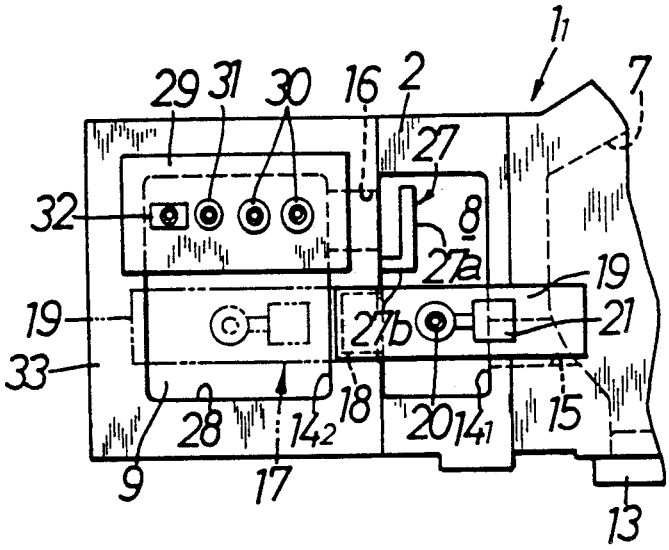

FIGS. 1 to 3 illustrate an aluminum alloy continuously melting and retaining furnace $\mathbf{1_1}$ used in casting an aluminum alloy as a metal. The furnace $\mathbf{1_1}$ has a body 2 which is provided with a preheating chamber 3 in which a material is preheated, a melting chamber 5 in which the preheated material is molten by a melting burner 4, a retaining chamber 7 which receives a molten metal m from the melting chamber 5 to retain the molten metal m under a heat retaining condition by a heat retaining burner 6, a treating chamber 8 in which the molten metal m fed from the retaining chamber 7 is subjected to a refining treatment such as removal of oxides, degassing or the like, and a ladling chamber 9 which receives the molten metal m which has been subjected to the refining treatment. The preheating chamber 3, the melting chamber 5 and the retaining chamber 7 are of a closed structure, but ceilings of the treating chamber 8 and the ladling chamber 9 are opened. Inspecting and cleaning ports 10 and 11 are provided through side walls of the melting chamber 5 and the retaining chamber 7 and they can be closed by furnace lids 12 and 13.

The retaining chamber 7, the treating chamber 8 and the ladling chamber 9 are arranged in a row. A molten metal inlet port 15 is provided through a first partition wall $\mathbf{14_1}$ between the retaining chamber 7 and the treating chamber 8 and is opposed to a second partition wall $\mathbf{14_2}$ between the treating chamber 8 and the ladling chamber 9. A molten metal outlet port 16 is provided through the second partition wall $\mathbf{14_2}$ so as to be opposed to the first partition wall $\mathbf{14_1}$. Thus, the molten metal inlet port 15 and the molten metal outlet port 16 are located in an offset relation to each other as shown in FIG. 2. The reason why the inlet port 15 and the outlet port 16 are offset is that the molten metal is to be held in the treating chamber 8 for some period of time. The volume of the treating chamber 8, the sectional area of the molten metal outlet port 16 and the like are determined corresponding to the amount of ladled molten metal so as to let the molten metal be held temporarily in the treating chamber 8 at least for about 3 minutes.

The treating chamber 8 is provided with a movable refiner 17 which will be described hereinafter. An upper end face of the second partition wall $\mathbf{14_2}$ lies below an upper end face of the first partition wall $\mathbf{14_1}$, and a post 18 stands on the upper end face of the second partition wall $14_2$. An elongated support plate 19 is spanned between an upper end face of the post 18 and the upper end face of the first partition wall $14_1$. A hollow rotating shaft 20 is rotatably supported in the support plate 19 to penetrate the latter substantially vertically and is driven by a drive motor 21 placed on an upper surface of the support plate 19. A hollow support shaft 24 for an impeller 23 is connected to a lower end of the hollow rotating shaft 20 through a connector 22, and the impeller 23 is disposed in the vicinity of a bottom of the treating chamber 8.

A gas supply source 26 is connected to an upper end of the hollow rotating shaft 20 for supplying an inert gas as a molten metal refining gas into the hollow rotating shaft 20 through a connecting tube 25. The respective interiors of the hollow rotating shaft 20 and the hollow support shaft 24 communicate with each other through the connector 22, so that if the inert gas is supplied from the gas supply source 26 into the hollow rotating shaft 20 while the impeller 23 is being rotated by the drive motor 21, the gas is ejected through a lower end opening of the hollow support shaft 24 to form fine bubbles.

A bubble baffle plate 27 stands from the bottom surface of the treating chamber 8 in proximity to the molten metal outlet port 16. The baffle plate 27 is comprised of a main body 27*a* opposed to the molten metal outlet port 16, and a connection 27*b* bent at a substantially right angle from the main body 27*a* and connected to the second partition wall $14_2$. The height h of the baffle plate 27 is set so that its upper end face may be substantially flush with or located above an upper edge of the opening of the molten metal outlet port 16.

The upper end faces of the side walls of the ladling chamber 9 and the second partition wall $14_2$ which define an opening 28 lie on the same horizontal plane, and on the side close to the molten metal outlet port 16, a support plate 29 is placed on the upper end face of the opening 28 to cover a portion of the opening 28. The support plate 29 is provided with a pair of bar-like heaters 30, a temperature sensor 31 such as a thermocouple, and a molten metal level sensor 32. The temperature sensor 31 is used to detect the temperature of the molten metal for controlling the heating temperature of the bar-like heaters 30 by a temperature controller (not shown), thereby maintaining the temperature of the molten metal in the ladling chamber 9 at a proper level.

In a casting operation, the support plate 19 of the refiner 17 is cantilever-supported on the upper end face of the post 18, as shown by a broken line in FIG. 3, with the impeller 23 immersed buried into the molten metal m in the ladling chamber 9. While the impeller 23 is being rotated, the inert gas is ejected through the lower end opening of the hollow support shaft 24 to produce fine inert gas bubbles.

This causes the molten metal m in the ladling chamber 9 to be subjected to stirring and to come into sufficient contact with the inert gas bubbles, whereby hydrogen gas and inclusions in the molten metal are adsorbed into the inert gas bubbles to float up to the surface of the molten metal and produce dross. The dross is removed out of the ladling chamber 9.

Thereafter, the support plate 19 of the refiner 17 is moved and spanned between the upper end faces of the first partition wall $14_1$ and the post 18, with the impeller 23 being buried into the molten metal m in the treating chamber 8. While the impeller 23 is being rotated, the inert gas is ejected through the lower end opening of the hollow support shaft 24 to generate fine inert gas bubbles.

Because the molten metal m stays for some time in the treating chamber 8 due to the offset disposition of the molten metal input port 15 and the molten metal outlet port 16, the molten metal m is stirred by the impeller 23 during such stay to come into sufficient contact with the inert gas bubbles, whereby hydrogen gas and inclusions in the molten metal are adsorbed into the inert gas bubbles to float up to the surface of the molten metal and produce dross.

In the course of floating of the inert gas bubbles with the hydrogen gas and the like entrained therein, such bubbles which are present around the molten metal outlet port 16 are prevented from flowing into the outlet port 16 by the bubble baffle plate 27, thus avoiding reduction in the degree of refining the molten metal m in the ladling chamber 9. The dross produced in the treating chamber 8 is removed from the opening thereof.

After refining treatment in the treating chamber 8, the molten metal m is continuously ladled from the ladling chamber 9 and subjected to casting.

Table 1 shows the content of hydrogen gas in the molten metal within the ladling chamber 9. The determination of the content of hydrogen gas was conducted by use of a vacuum solidification process through five samplings, and the content of hydrogen gas is represented in terms of the volume (cc) of hydrogen gas in the molten metal 100 g.

TABLE I

| | Number of samplings | | | | |
|---|---|---|---|---|---|
| | 1 | 2 | 3 | 4 | 5 |
| Content of hydrogen gas (cc/100 g) | 0.15 | 0.13 | 0.16 | 0.15 | 0.14 |

When a conventional lance was used, the content of hydrogen gas was 0.45 to 0.55 cc/100 g before treatment and it was about 0.4 cc/100 g even after treatment. According to the present invention, however, the content of hydrogen gas can be substantially reduced as compared with the values after treatment obtained by the conventional lance, as apparent from Table I.

Figure 4:
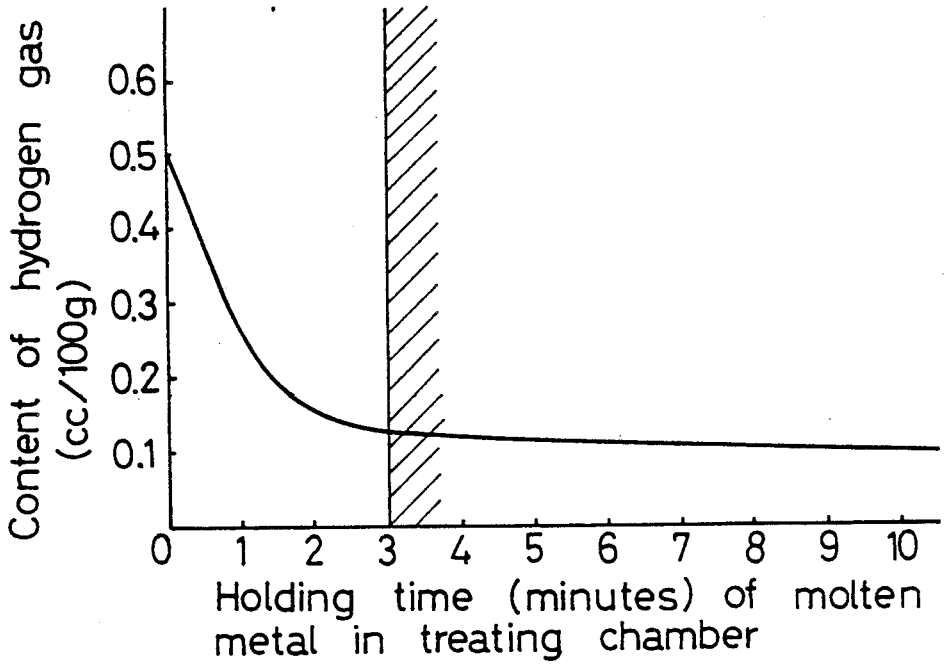
FIG. 4 is a graph illustrating a relationship between the time a molten metal is held in a treating chamber and the content of hydrogen gas.

FIG. 4 illustrates a relationship between the residence or holding time of the molten metal and the content of hydrogen gas. As apparent from FIG. 4, degassing is performed to a sufficient extent by holding the molten metal m in the treating chamber 8 for 3 minutes or more.

Table II shows the content of inclusions such as oxides and the like in the molten metal within the ladling chamber 9.

The determination of the content of the inclusions was carried out in a procedure comprising: (1) sampling five times and casting the samples into thin plate-shaped test pieces, (2) making 10 cuts in each of the test pieces in parallel at predetermined intervals and braking each test piece along each of the cuts, and (3) observing a total of 20 broken surfaces of the 11 divided fragments obtained for each test piece by a loupe to count the number of the inclusions found on the broken surfaces. In this case, the inclusion present astride the adjacent, paired broken surfaces was counted as one.

Accordingly, the content of inclusions is represented by the number per 20 broken surfaces.

TABLE II

| | Number of samplings | | | | |
|---|---|---|---|---|---|
| | 1 | 2 | 3 | 4 | 5 |
| Content of inclusions (number/20 broken surfaces) | 0 | 0 | 0 | 0 | 0 |

When the conventional lance was used, the content of the inclusions was 4 to 5/20 broken surfaces before treatment and it was 4/20 broken surfaces even after treatment. According to the present invention, however, the content of the inclusions could be reduced to zero or a negligible value, as apparent from Table II.

The above-described refining treatment is performed through the generation of the inert gas bubbles and the mechanical stirring provided by the rotation of the impeller 23 and hence, the loss of metal is as small as 1% or less and can be reduced to a half amount as compared with a case using a flux where a metal loss is 2%. This leads to a good yield.

Figure 5:
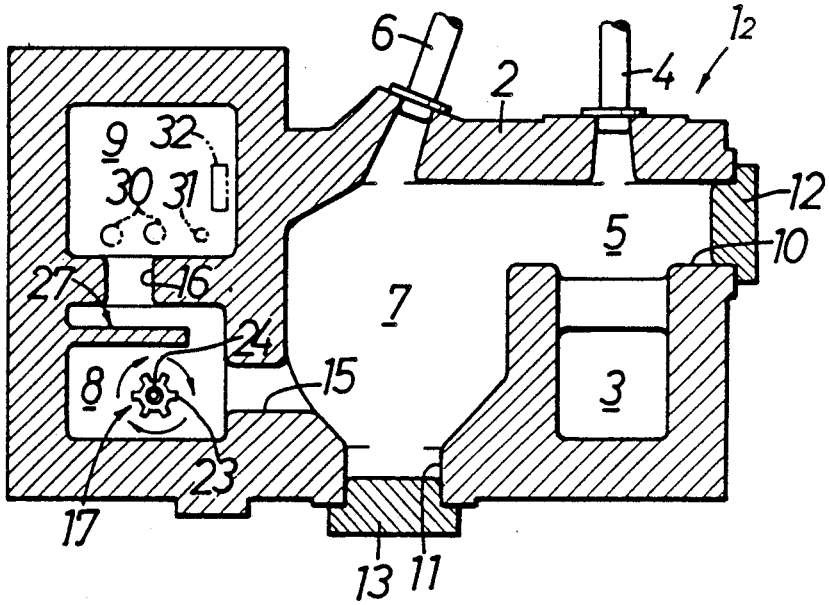
FIG. 5 is a cross-sectional view similar to FIG. 2 but illustrating a metal continuously melting and retaining furnace according to another embodiment of the present invention.

FIG. 5 illustrates another embodiment of an aluminum alloy continuously melting and retaining furnace. In this retaining furnace 12, a retaining chamber 7, a treating chamber 8 and a ladling chamber 9 are disposed in a hook-shaped arrangement as a whole, and a bubble baffle plate 27 is formed into a flat plate. Other constructions are the same as in the previous embodiment and hence, the same portions are designated by the same reference numerals.

It should be noted that if the volume of the treatment chamber 8, the sectional area of the molten metal outlet port 16, the positions of the molten metal inlet and outlet ports 15 and 16 and the like are determined properly so as to correspond to the amount of ladled melt for preventing the inert gas bubbles from flowing into the molten metal outlet port 16, it may then become possible to dispense with the bubble baffle plate 27.

What is claimed is:

1. A metal continuously melting and retaining furnace having a substantially rectangular cross-section, said furnace comprising:

a preheating chamber for preheating a metallic material to be fed therein;

a melting chamber connected to said preheating chamber for melting the metallic material into a molten metal;

a retaining chamber connected to said melting chamber for retaining the molten metal from said melting chamber;

a treating chamber connected to said retaining chamber;

a ladling chamber connected to said treating chamber with a partition wall therebetween having an outlet port;

a bubble baffle means for baffling said molten metal and provided in the vicinity of the outlet port; and a refining means for refining the molten metal and positioned in the vicinity of the partition wall, wherein said preheating, melting, retaining, treating and ladling chambers are positioned in a manner such that cross-sections of all the chambers constitute the substantially rectangular cross-section of said furnace.

2. A metal continuously melting and retaining furnace according to claim 1, wherein said bubble baffle means is a plate extending out of said partition wall and covering said outlet port.

3. A metal continuously melting and retaining furnace according to claim 1 or 2, wherein said retaining, treating and ladling chambers are disposed in a row.

4. A metal continuously melting and retaining furnace according to claim 1 or 2, wherein said retaining, treating and ladling chambers are arranged in a substantially L-shape arrangement.

5. A metal continuously melting and retaining furnace according to claim 1 or 2, wherein said refining means further includes a feeding means for feeding bubbles of a refining gas.

6. A metal continuously melting and retaining furnace according to claim 5, wherein said refining means comprises a support plate removably positioned on said treating chamber, a vertically extending hollow rotating shaft rotatably supported in said support plate, a gas supply source connected to an upper end of said hollow rotating shaft, a hollow support shaft connected to a lower end of said hollow rotating shaft, and an impeller for stirring said molten metal.

7. A metal continuously melting and retaining furnace according to claim 6, wherein said impeller can assume a position in the vicinity of the bottom surface of said treating chamber.

8. A metal continuously melting and retaining furnace according to claim 3, wherein said bubble baffle plate has a cross-section of a substantially L-shape.

9. A metal continuously melting and retaining furnace according to claim 8, wherein said bubble baffle plate comprises a main body facing to said outlet port and a connection bent at a substantially right angle from said main body and connected to said partition wall.

10. A metal continuously melting and retaining furnace according to claim 4, wherein said bubble baffle plate is formed into a flat plate.

11. A metal continuously melting and retaining furnace according to claim 5, wherein said refiner is also usable in the ladling chamber and is constructed to be selectively placed in said treating and ladling chambers, said refiner being capable of being mounted to and removed from the treating and ladling chambers.

12. A metal continuous melting and retaining furnace according to claim 1 or 2, wherein said refining means is movable between said treating and ladling chambers.

13. A metal continuously melting and retaining furnace comprising:

a melting chamber in the furnace for melting a metallic material into a molten metal;

a retaining chamber connected to said melting chamber in the furnace for retaining therein the molten metal fed from the melting chamber;

a treating chamber connected to said retaining chamber via an inlet port in the furnace for subjecting the molten metal fed from the retaining chamber to a refining treatment; and a ladling chamber connected to said treating chamber via an outlet port in the furnace for permitting the refined molten metal to be ladled out therefrom.

14. A metal continuously melting and retaining furnace according to claim 13, further comprising a preheating chamber which is connected to said melting chamber for preheating the metallic material to be fed to said melting chamber.

15. A metal continuously melting and retaining furnace according to claim 13, wherein said melting chamber and said retaining chamber are formed into a closed structure whereas said treating chamber and said ladling chamber are formed into an open structure.

16. A metal continuously melting and retaining furnace according to claim 14, wherein said preheating chamber, melting chamber and said retaining chamber are formed into a closed structure whereas said treating chamber and said ladling chamber are formed into an open structure.

17. A metal continuously melting and retaining furnace according to claim 13, wherein said retaining chamber, treating chamber and said ladling chamber are arranged in a row within said furnace.

18. A metal continuously melting and retaining furnace according to claim 13, wherein said retaining chamber, treating chamber and said ladling chamber are arranged in a substantially L-shaped configuration within said furnace.

19. A metal continuously melting and retaining furnace according to claim 14, wherein burner means are mounted within said furnace exposed to said preheating chamber and said melting chamber, respectively.

* * * * *